US005548101A

United States Patent [19]

Lee

[11] Patent Number: 5,548,101

[45] Date of Patent: Aug. 20, 1996

[54] MICROWAVE OVEN WITH A FUNCTION OF INDUCTION HEATING AND THE CONTROL METHOD THEREOF

[75] Inventor: Eung H. Lee, Anyang, Rep. of Korea

[73] Assignee: Samsung Electronics Co., Ltd., Suwon, Rep. of Korea

[21] Appl. No.: 355,198

[22] Filed: Dec. 8, 1994

[30] Foreign Application Priority Data

Dec. 15, 1993 [KR] Rep. of Korea ..... 93-27833

[51] Int. Cl.[6] ..... H05B 6/06; H05B 6/68

[52] U.S. Cl. ..... 219/601; 219/705; 219/680; 219/720

[58] Field of Search ..... 219/601, 625, 219/626, 627, 680, 710, 715, 716, 720, 704, 705

[56] References Cited

U.S. PATENT DOCUMENTS

| | | | |
|---|---|---|---|
| 4,456,807 | 6/1984 | Ogino et al. | 219/726 |
| 4,464,553 | 8/1984 | Ikeda | 219/726 |
| 4,686,340 | 8/1987 | Fukasawa | 219/626 |
| 4,749,836 | 6/1988 | Matsuo et al. | 219/626 |
| 4,900,884 | 2/1990 | Aoki | 219/601 |
| 5,177,333 | 1/1993 | Ogasawara | 219/601 |
| 5,360,965 | 11/1994 | Ishii et al. | 219/705 |
| 5,362,946 | 11/1994 | Matsushima | 219/704 |
| 5,373,145 | 12/1994 | Endo et al. | 219/704 |

FOREIGN PATENT DOCUMENTS

| | | | |
|---|---|---|---|
| 1-107016 | 4/1989 | Japan . | |
| 1-246788 | 10/1989 | Japan | 219/601 |

*Primary Examiner*—Philip H. Leung

*Attorney, Agent, or Firm*—Burns, Doane, Swecker & Mathis, L.L.P.

[57] ABSTRACT

A microwave oven may perform an induction heating mode, dielectric heating mode, and induction/dielectric switch heating mode. The invention is adapted to a microwave oven, in which an induction coil is mounted on the outer bottom wall of a heating chamber, and a heat insulation member is mounted on the induction coil. The microwave oven comprises an induction heating section including an induction coil, a dielectric heating section including a magnetron, a power supply section for generating high frequency power by switching D.C. power obtained by rectifying commercial A.C. power, the power supply section including a power transistor for switching the D.C. power, a switching control section for controlling the switching operation of the power supply section, a door sensing section for determining whether or not door is open, a load sensing section for sensing the material of a cooking vessel loaded in the heating chamber, and, a microprocessor for controlling the high frequency power to be selectively or alternately connected to either of the heating sections based on the state of the door and the material of the cooking vessel.

26 Claims, 9 Drawing Sheets

START
B1
IS DOOR OPENED ?
S10
YES
NO
COMBINATION HEATING ?
S60
YES
NO
Al, Cu VESSEL ?
S20
YES
NO
B2
D/HEATING VESSEL ?
S30
YES
NO
COMBINATION HEATING ?
S70
YES
NO
I/HEATING VESSEL ?
S40
YES
NO
B3
COMBINATION VESSEL ?
S50
NO
YES
B4
COMBINATION HEATING ?
S120
YES
NO
B5
IS DOOR OPENED ?
S140
YES
NO
B6
S80
PERFORM D/HEATING
PERFORM HEATING MANNER SELECTED BY USER
S150
B7
B8
B9

MICROWAVE OVEN WITH A FUNCTION OF INDUCTION HEATING AND THE CONTROL METHOD THEREOF

BACKGROUND OF THE INVENTION

1. Field of the Invention

The present invention is related to a microwave oven with a function of induction heating and the control method thereof, and particularly to a microwave oven incorporating an induction coil, which heats the foods to be cooked by a heating manner suitable for the cooking vessel after sensing the material of the cooking vessel.

2. Description of the Prior Art

For the purpose of improving the taste of foods, an additional heating instrument has been incorporated in the microwave oven which cooks foods utilizing the principle of dielectric heating. For example, one type of known microwave oven includes an electric heater in the heating chamber thereof, in which the electric heater is alternately or concurrently activated with the dielectric heating unit to increase the taste of foods.

In addition, another known type of microwave oven includes an induction coil which produces a high frequency magnetic field to cause eddy currents to flow through a cooking vessel made of steel or stainless steel, and thereby heats the foods by the Joule heat produced in the cooking vessel. A typical microwave oven with induction coil is disclosed in Japanese patent laid-open No. 91.107016. In the disclosed microwave oven, the induction coil is arranged between a wave guide mounted on the heating chamber and a outer case. A magnetic shielding member is provided for preventing the wave guide from being heated by the magnetic field produced by the induction coil, for example, an aluminum sheet mounted on the wave guide, and a thermal insulation member normally made of a mica sheet mounted on the outer case.

However, the disclosed microwave oven simply incorporates the induction coil, without any functionally combined relationship. Accordingly, dielectric heating or induction heating cannot be performed without both moving the cooking vessel and/or moving foods from one vessel to another suitable for the heating manner.

To alleviate the aforementioned problem, another microwave oven has been developed with an induction coil being arranged in the space formed between the bottom wall and the base cover as disclosed in U.S. Pat. No. 5,177,333.

The disclosed microwave oven comprises a heating chamber whose bottom wall is made of a non-magnetic metal mesh having a size in a range from 10 mesh to 25 mesh, an induction coil disposed in the vicinity of the outer bottom wall of the heating chamber, and a turn table preferably made of dielectric material. In the disclosed microwave oven, if the user selects a specific function key, (for example, a "frying pan" key), the microwave oven initially performs induction heating for a predetermined time interval to cook the protein in the surface portion of the meat, and then automatically performs dielectric heating to heat the internal portion of the meat.

With regard to this last point, the microwave oven disclosed in the latter patent publication has the advantage in that the user doesn't have to move the foods from one vessel to another suitable for the subsequent heating manner, or move the vessel itself because it is functionally combined with the induction heating part thereof to some extent, as compared to the microwave oven disclosed in the former patent publication.

However, when the "frying pan" function is performed in the state that the foods are contained in a steel vessel with a tall body part, the microwave oven disclosed in the latter patent publication still has a problem in that the foods are not satisfactorily cooked because the amount of the microwave energy reflecting from the body part of the cooking vessel increases during dielectric heating. In other words, the cooking performance is subjected to restrictions depending on the shape or material of the cooking vessel. Furthermore, the microwave oven does not automatically execute cooking using the heating manner suitable for the material of the cooking vessel.

SUMMARY OF THE INVENTION

It is an object of the present invention to provide a microwave oven with a function of induction heating, which is contrived to maximize the convenience of utilization as seen from the standpoint of the user.

It is another object of the present invention to provide a microwave oven with a function:of induction heating, which is contrived to select a heating manner suitable for the material of a cooking vessel being used and then cook the foods by using the selected heating manner.

It is still another object of the present invention to provide a microwave oven with a function of induction heating, which is contrived to selectively or alternately execute either induction or dielectric heating according to the material of a cooking vessel being used.

It is still another object of the present invention to provide a microwave oven with a function of induction heating, which is contrived to automatically select a proper heating manner accordingly, whether the door is opened or not, and then cook the foods by the selected heating manner.

To achieve these objects, the present invention may be applied to a microwave oven which may perform either induction heating or dielectric heating in the heating chamber. The microwave oven of the present invention comprises an induction heating section including an induction coil; a dielectric heating section including a magnetron; a power supply section for generating high frequency power by switching D.C. power obtained by rectifying commercial A.C. power, the power supply section including a power transistor for switching the D.C. power; a switching control section for controlling the switching operation of the power supply section; a door sensing section for sensing whether or not the door is open; a load sensing section for sensing the material of the cooking vessel loaded in the heating chamber; and, a microprocessor for controlling the high frequency power to be selectively or alternately connected to either of the heating sections based on the state of the door and the material of the cooking vessel.

On the other hand, a control method for a microwave oven with a function of induction heating, in which either induction heating or dielectric heating may be performed in a heating chamber, the control method comprising the steps of: (1) sensing whether or not a door for the heating chamber is open, (2) determining the material of a cooking vessel; and, (3) selectively operating a proper heating manner based on the state of the door and the material of the cooking vessel, and issuing an alarm when the cooking vessel is not proper to either of the heating manners.

BRIEF DESCRIPTION OF THE DRAWINGS

These and other aspects of the present invention are clarified in the accompanying drawings in which.

DETAILED DESCRIPTION OF THE PREFERRED EMBODIMENT

For a better understanding of the present invention, together with other and further objects, advantages and capabilities thereof, reference is made to the following disclosure and appended claims in connection with the above-described drawings.

Before progressing to a full-dress explanation, the fundamental construction of a microwave oven of this invention will be explained.

In the construction, an induction coil is arranged in the space formed between the bottom wall of a heating chamber and the base cover, and thermal insulating and mica sheets are put on the induction coil in order. Moreover, the bottom wall of the heating chamber is formed of a mesh plate having numerous small holes. These small holes are provided for both enabling the induction heating and preventing microwave energy from leaking out of the heating chamber during the dielectric heating.

Figure 1A:
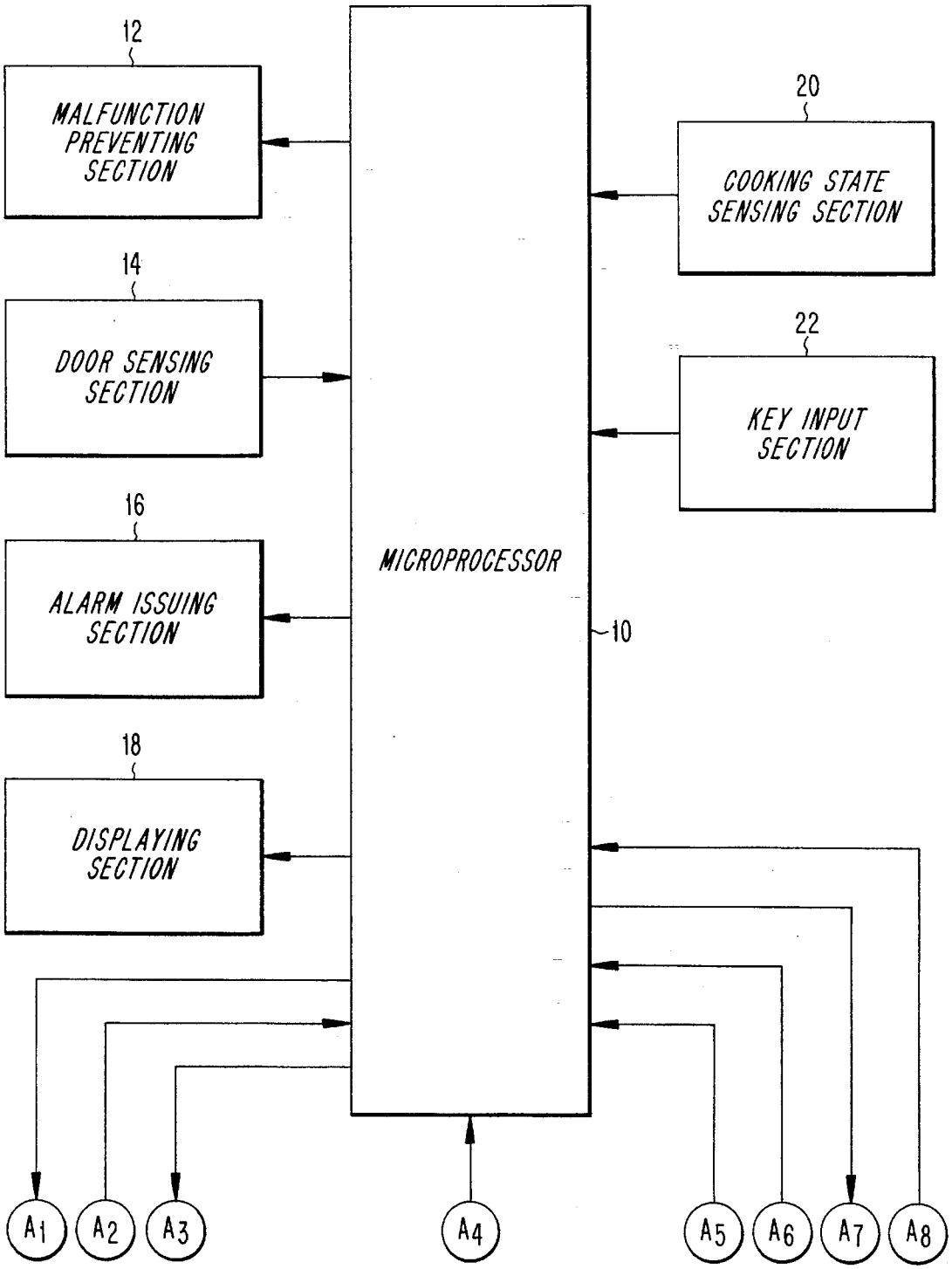
FIGS. 1(A) through (C) are functional block diagrams illustrating a microwave oven with the function of induction heating according to the present invention.
Figure 1B:
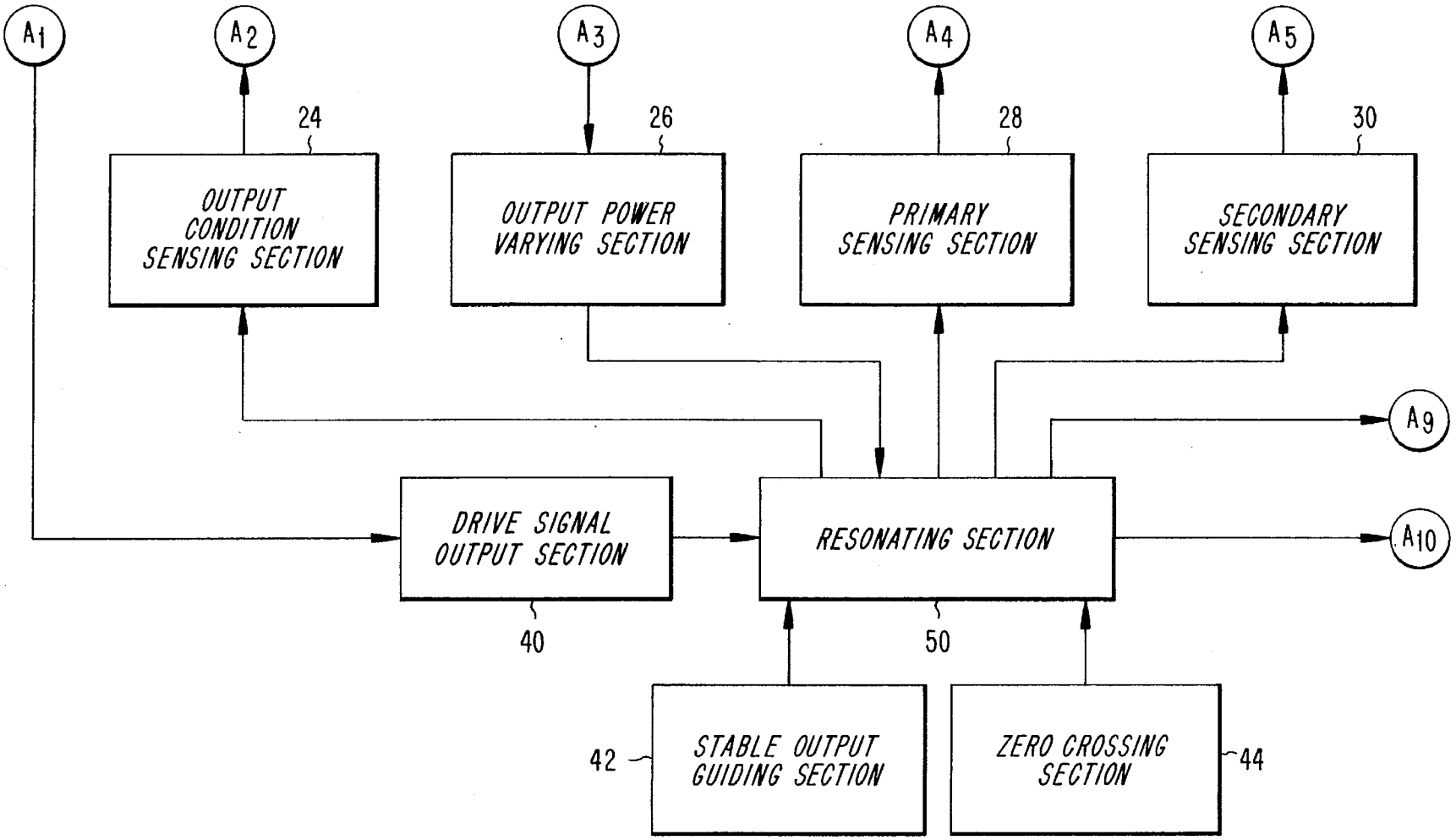
Figure 1C:
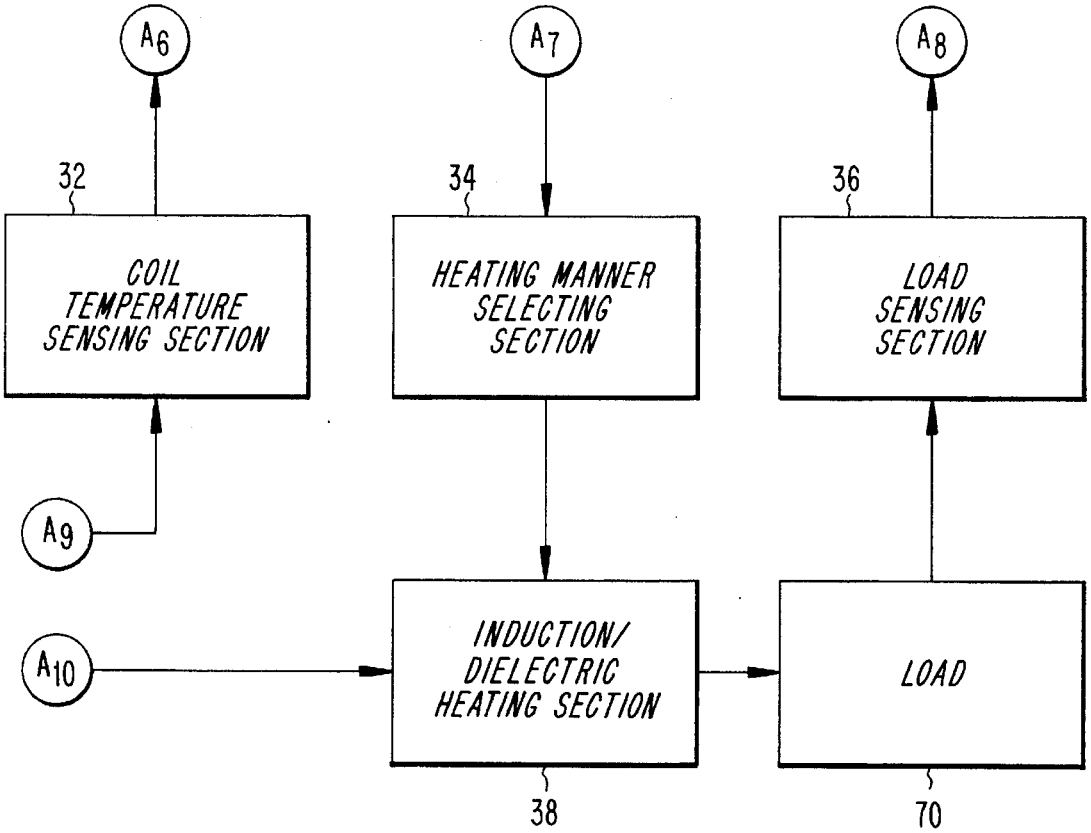

FIGS. 1(A) through (C) are functional block diagrams illustrating a microwave oven with the function of induction heating according to the present invention.

All functional blocks of the best preferred embodiment are shown in FIGS. 1(A), 1(B) and 1(C) but some blocks may be omitted according to the circumstances.

Referring to FIGS. 1(A), 1(B) and 1(C), the microwave oven according to the present invention fundamentally comprises a microprocessor 10 for the whole operations of the apparatus, a heating section (hereinafter, called an induction/dielectric heating section) 38 including an induction heating part having an induction coil and a dielectric heating part having a magnetron, a resonating section 50 for supplying high frequency electric power to the induction/dielectric heating section 38, a sensing section (hereinafer, called a door sensing section) 14 for sensing the opening and closing of the door, a load sensing section 36 for sensing the material of the cooking vessel loaded in the heating chamber, a drive signal output section 40 for producing a drive signal to operate the resonating section 50, and a heating manner selecting section 34 for selectively connecting the high frequency power to either the induction heating part or dielectric heating part.

For the purpose of serving the user's convenience, the microwave oven according to the present invention further comprises a cooking state sensing section for sensing gas concentration, humidity, temperature, or the like in the heating chamber, a key input section 22 used for selecting the kind of cooking, heating manner, or the like, an alarm issuing section 16 for issuing an alarm that cooking is completed or that some errors have occurred in operation, and a displaying section 18 for displaying the selected function, the existing operation state, or the like.

For the purpose of serving safe and stable operations, the microwave oven according to the present invention further comprises a primary sensing section 28 for sensing the condition of the primary part of the resonating section 50, a secondary sensing section 30 for sensing the condition of the secondary part of the resonating section 50, an output condition sensing section 24 for sensing the condition of power output from the resonating section 50, an output power varying section 26 for varying the magnitude of high frequency power by varying the duty cycle of the high frequency power output from the resonating section 50, a coil temperature sensing section 32 for sensing the temperature of the induction coil, a malfunction preventing section 12 for preventing the malfunction of the induction/dielectric heating section 38, a stable output guiding section 42 for stably increasing the power to be supplied to the magnetron from a predetermined lower level to a reference level when the filament of the magnetron is not fully heated at the initial operation thereof, and a zero crossing section 44 for turning on the power transistor of the resonating section 50 only when the voltage across the collector and emitter terminals of the power transistor is lower than a predetermined reference value so as to protect the power transistor and decrease switching loss.

Figure 2A:
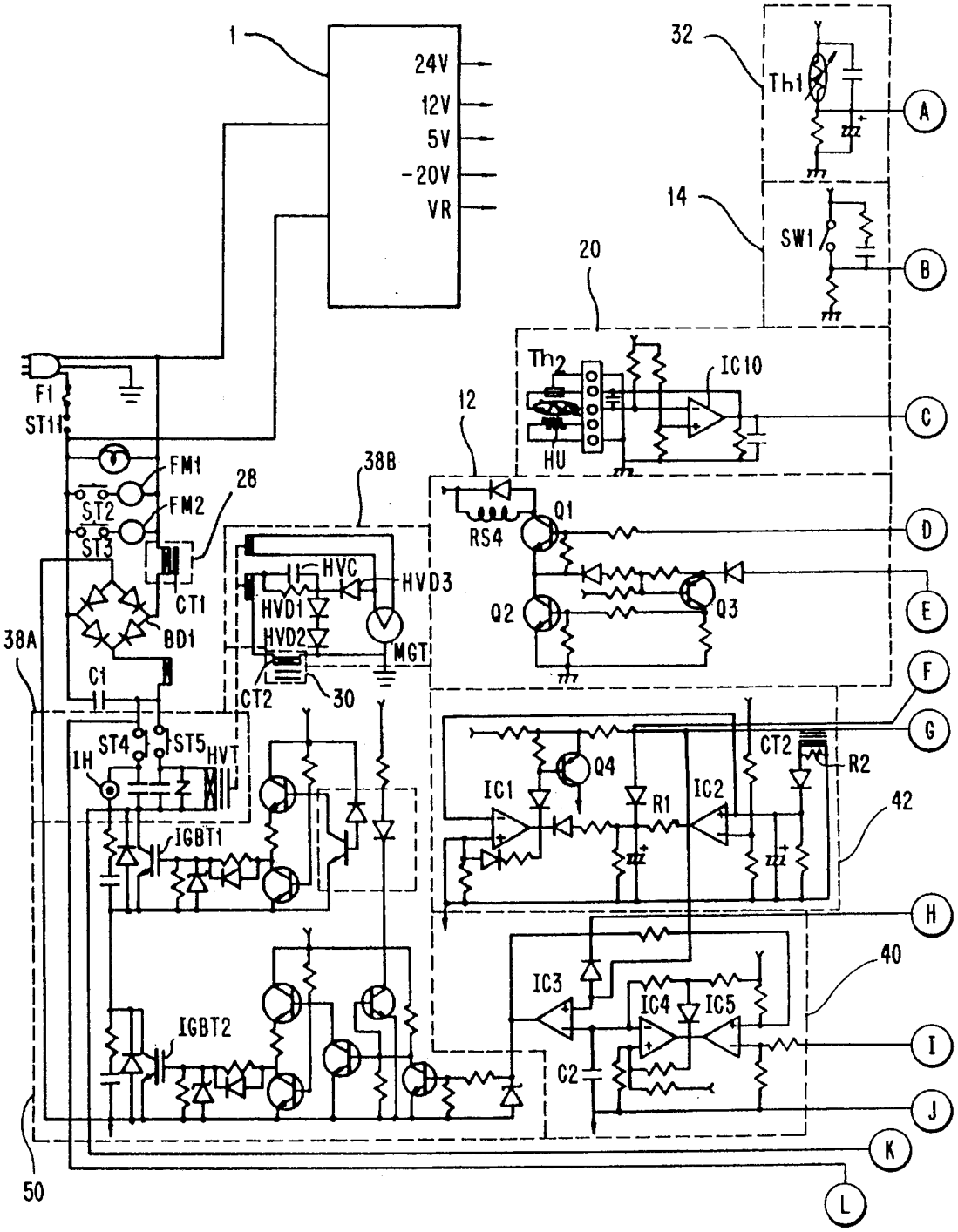
FIGS. 2(A) and (B) are detailed circuit diagrams of FIGS. 1(A) through (C); and, FIGS. 3(A) through (D) are flow charts illustrating a control method for a microwave oven with the function of induction heating according to the present invention.
Figure 2B:
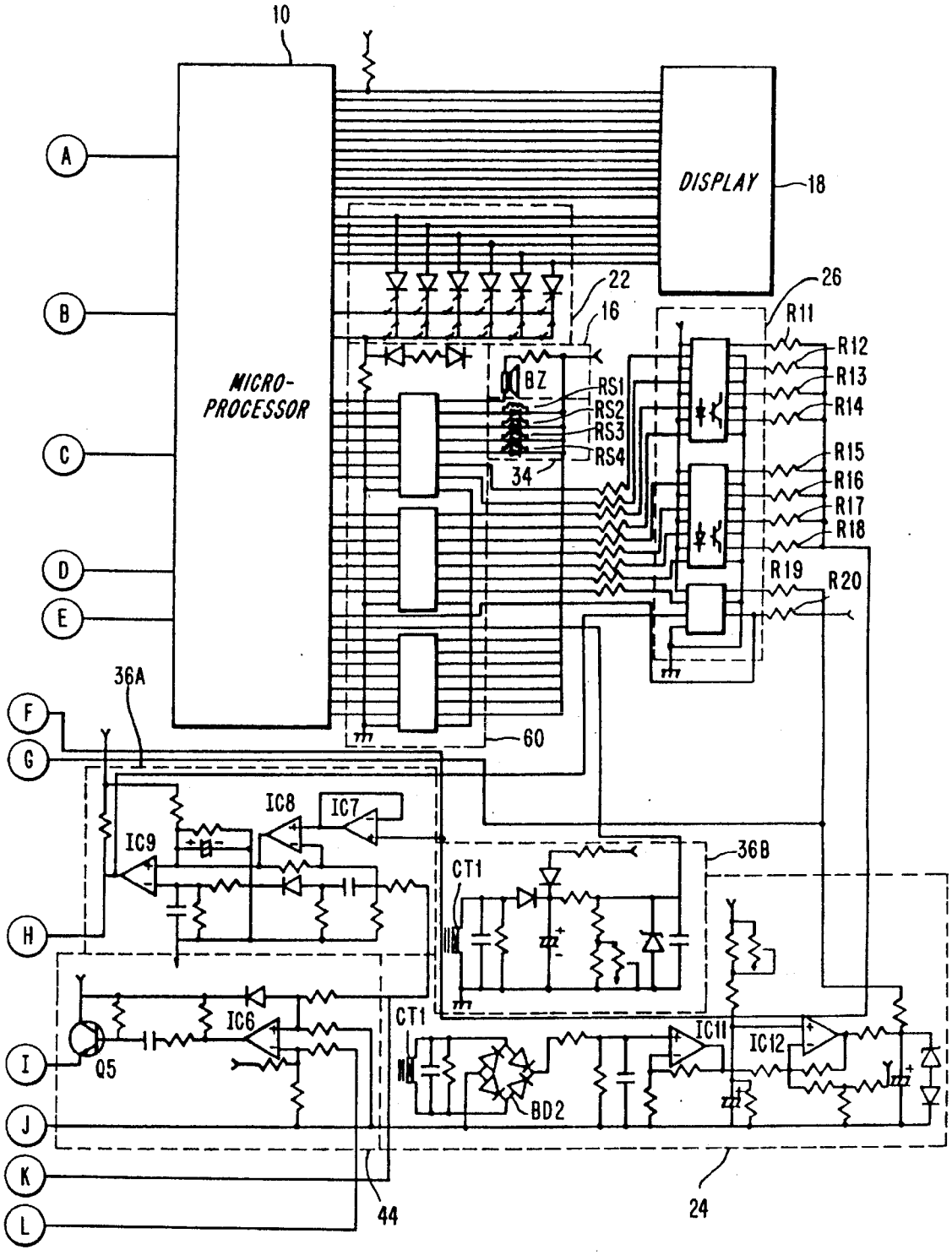
Figure 3A:
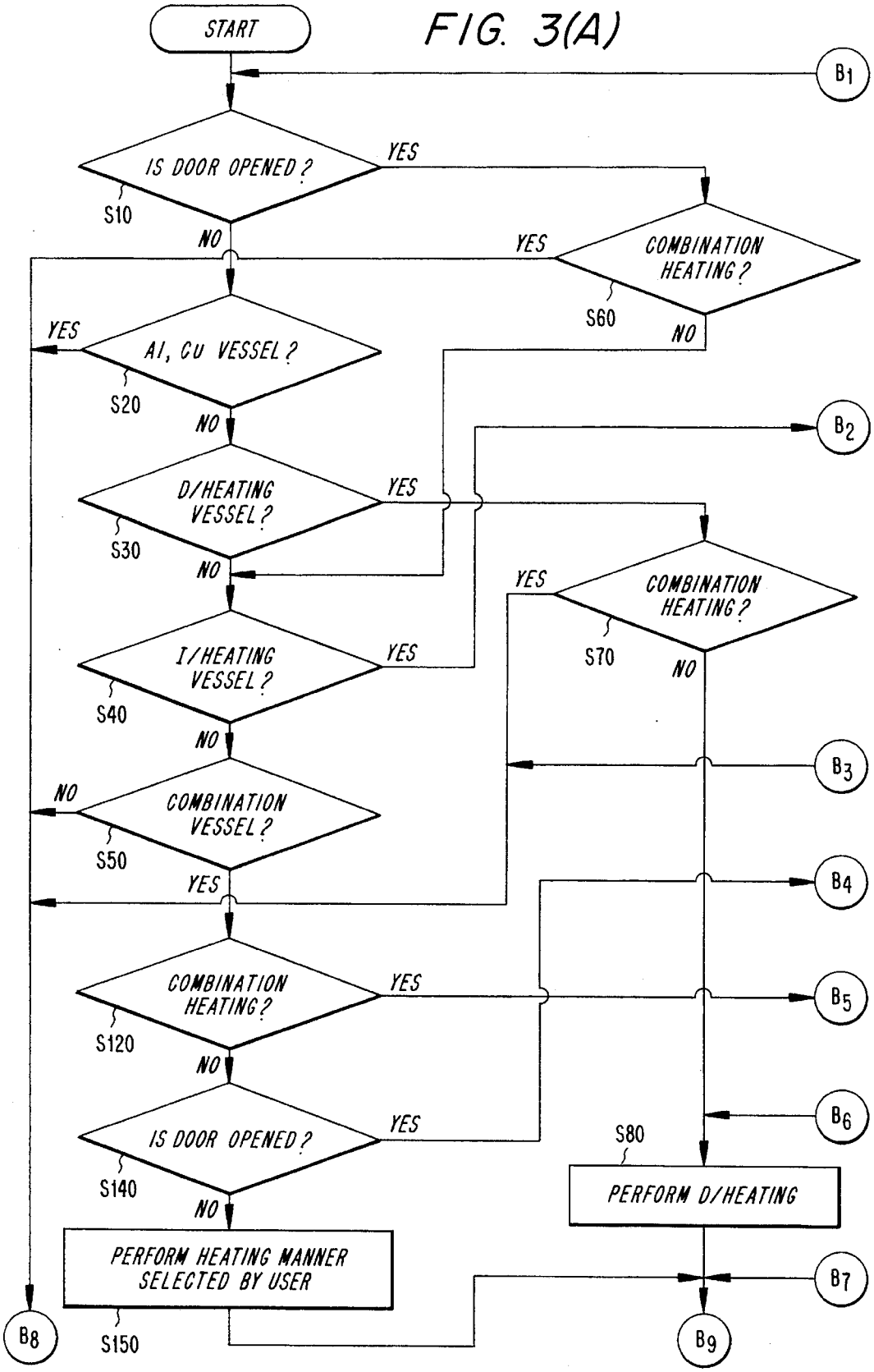
Figure 3B:
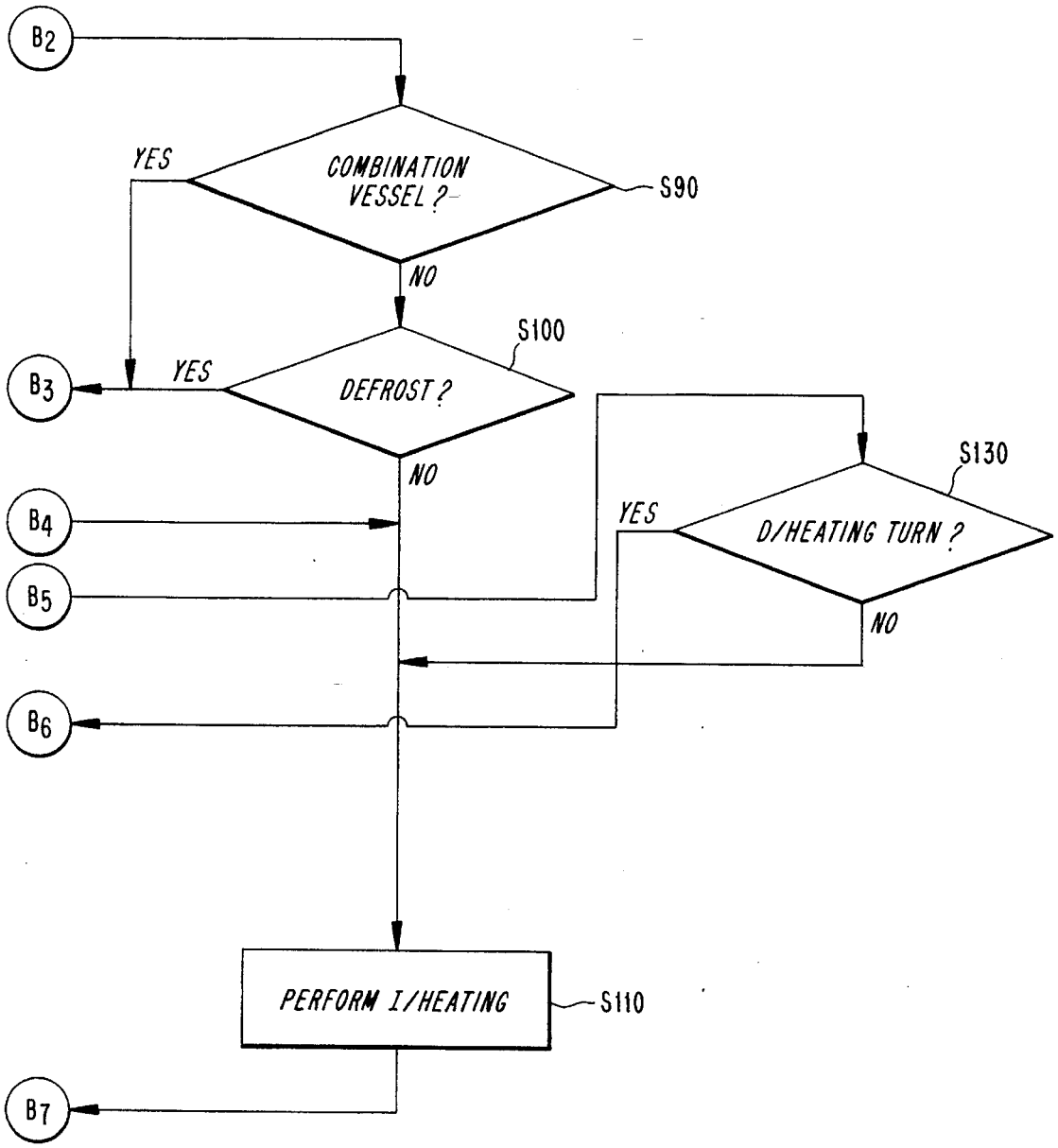
Figure 3C:
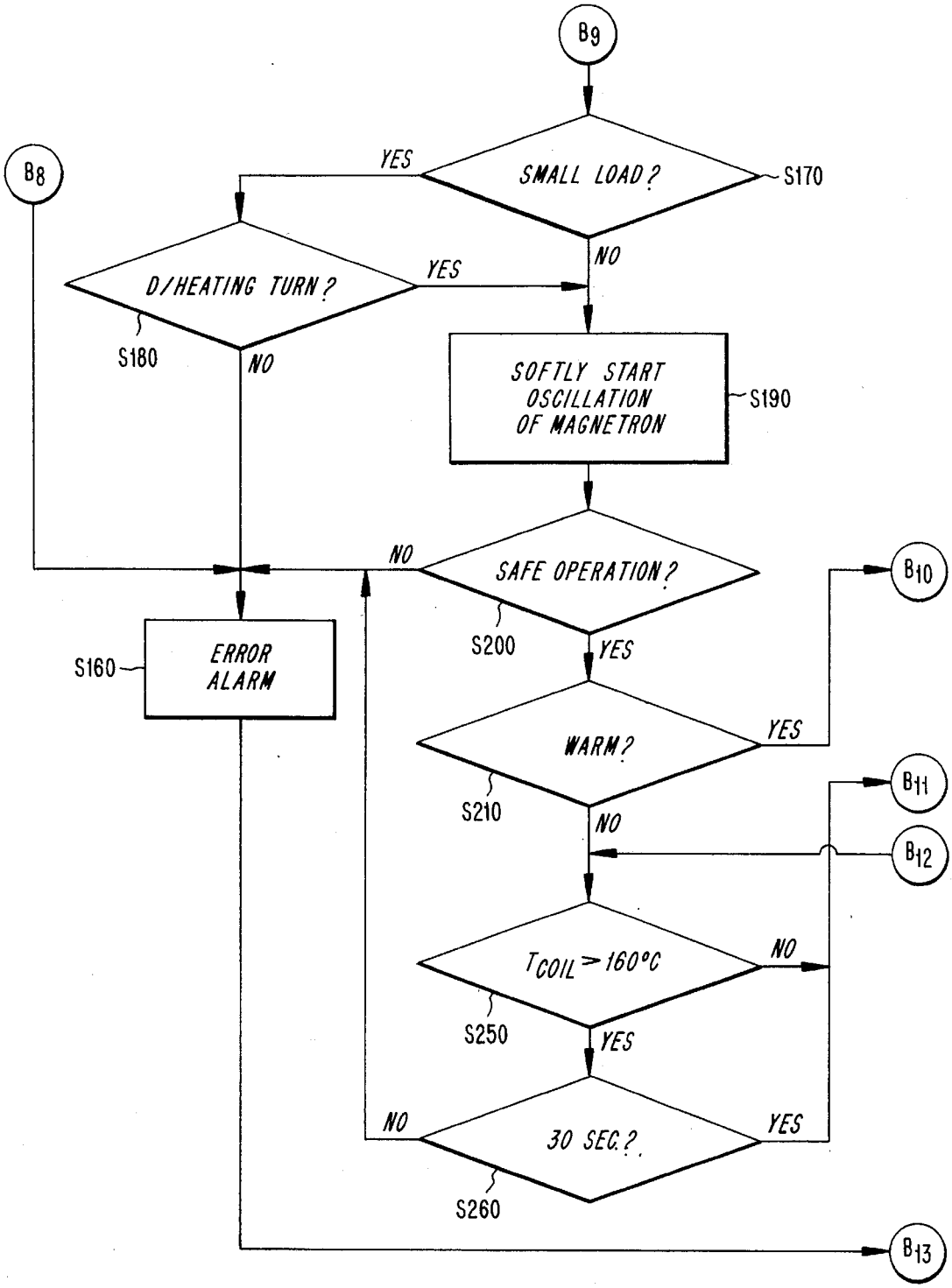
Figure 3D:
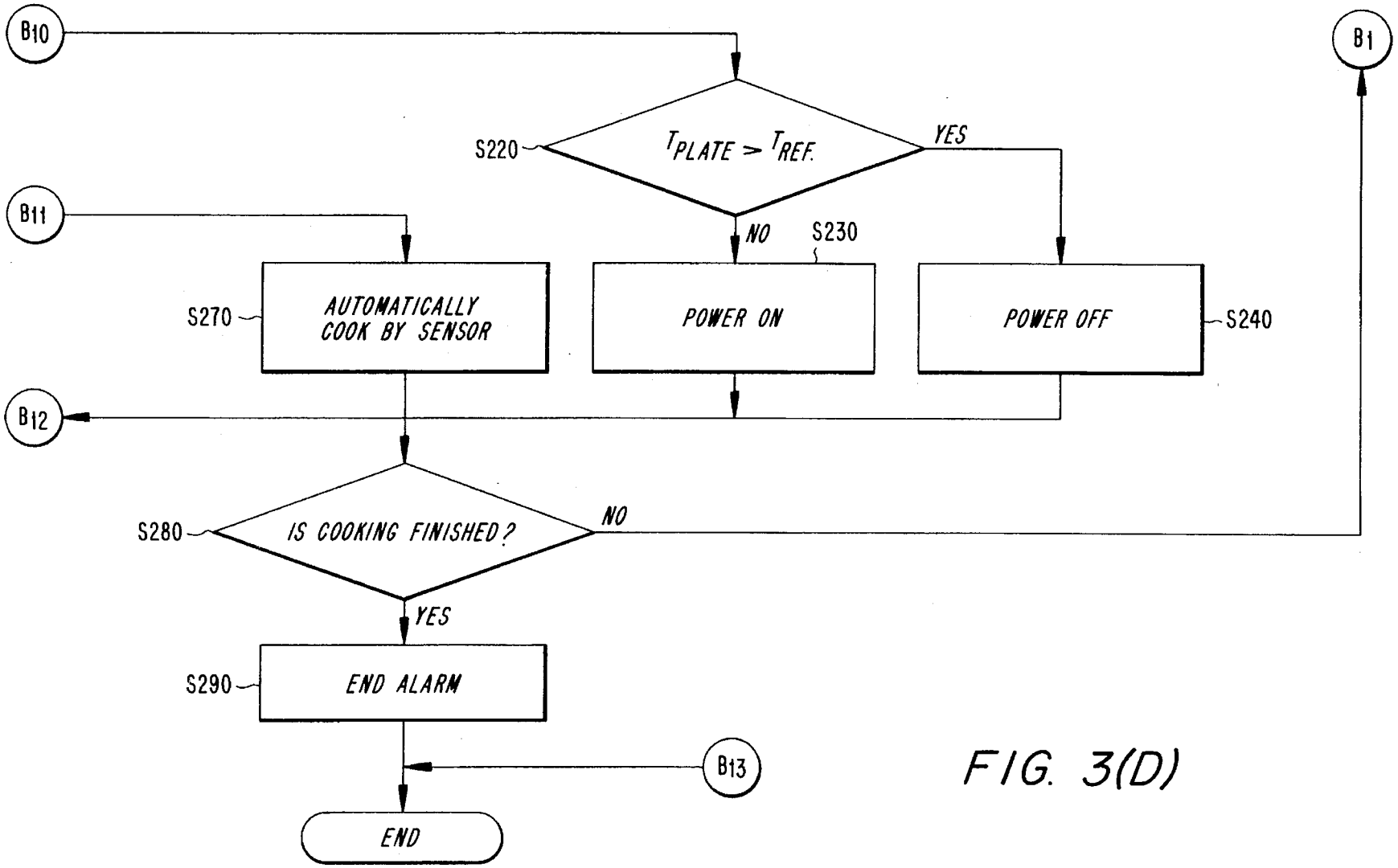

FIGS. 2(A) and (B) are detailed circuit diagrams of FIGS. 1(A) through (C).

Referring to FIGS. 2(A) and (B), reference numeral 1 denotes a power supply unit for generating D.C. power from a commercial A.C. power supply by a rectifier circuit and voltage regulator circuit, (not shown), and then supplying it to the circuit components of the microwave oven.

In FIGS. 2(A) and (B), the reference character F1 denotes a fuse, ST1 denotes a contact part of the main switch, FM1 and FM2 denote fan motors for respectively cooling the induction coil and the magnetron, and ST2 and ST3 denote contact parts of the respective fan motor FM1 or FM2. Reference numeral BD1 denotes a diode bridge, which performs full-wave rectification of commercial A.C. power. Next, the power rectified by the diode bridge BD1 is smoothed through a condenser C1, and then supplied to the resonating section 50 via the induction/dielectric heating section 38.

The induction/dielectric heating section 38 includes an induction heating part 38A having an induction coil IH and peripheral components, and a dielectric heating part 38B having magnetron and voltage doubling components.

The resonating section 50 is formed of a fly-back type invertor circuit, in which IGBTs (Insulated Gated Bipolar Transistors), endurable to a large current and high voltage, may be preferably used as power switching transistors.

The dielectric heating part 38B boosts the high frequency power by using a high voltage transformer HVT, then doubles the boosted voltage by the voltage doubling circuit HVC, HVD1 to HVD3, and then oscillates the magnetron MGT.

The door sensing section 14 includes a micro-switch SW1 being turned on or off according to the opening or closing of the door, thereby providing high or low level signals to the microprocessor 10.

The drive signal output section 40 includes comparators IC3 to IC5 and peripheral components, which turn the power transistors IGBT1 and IGBT2 of the resonating section 50 on or off according to the voltage level of the output terminal of the IC3.

To be more exact, when the electrical potential of the non-inverted (+) terminal of the comparator IC3 is higher than that of the inverted (−) terminal thereof, the output terminal thereof is at a high level to turn on the power transistors IGBT1 and IGBT2. On the other hand, when the electric potential of the inverted (–) terminal of the comparator IC5 is higher than that of the non-inverted (+) terminal thereof, the output terminal of the comparator IC5 is at a low level. As a result, the electric potential of the inverted (–) terminal of the comparator IC3 decreases gradually by the discharge action of the condenser C2, thereby rendering the voltage level of the output terminal of the comparator IC3 high.

Conversely, when the electric potential of the inverted (–) terminal of the comparator IC5 is lower than that of the non-inverted (+) terminal thereof, the output terminal of the comparator IC5 is at a high level. As a result, the electric potential of the inverted (–) terminal increases gradually by the charge action of the condenser C2, thereby rendering the voltage level of the output terminal of the comparator IC3 low.

When repeatedly performing the aforementioned operation, voltage with a triangular wave form is applied to the inverted (–) terminal of the comparator IC3, thereby repeatedly turning the power transistors IGBT1 and IGBT2 on and off. A comparator IC4 is used for limiting the electric potential of the inverted (–) terminal of the comparator IC3 within a predetermined range.

The load sensing section 36 includes a first load sensing part 36A for stopping the operation of the resonating section 50 when an inappropriate cooking vessel is loaded into the heating chamber during induction heating, and a second load sensing part 36B for sensing the material of the load, that is, the cooking vessel.

The first load sensing part 36A includes comparators IC7 to IC9, and peripheral components thereof. In the first load sensing part 36A, the non-inverted terminal (+) of the comparator IC9 is connected to the output terminal of the comparator IC8, and the inverted(–) terminal thereof is connected to the collector terminal of the power transistor IGBT1. When a cooking vessel, such as an aluminum or bronze vessel which reflects magnetic flux, is loaded into the heating chamber, a large current flows though the induction coil IH due to the reflection of the magnetic flux, thereby resulting in an increase in the electric potential at the collector terminal of the power transistor IGBT1, that is, the electric potential at the inverted (–) terminal of the comparator IC9. Next, the output terminal of the comparator IC9 is in a low state, the electric potential at the non-inverted (+) terminal of the comparator IC3 decreases, and the output terminal of the comparator IC3 is in a low state. Finally, the power transistors IGBT1 and IGBT2 are then turned off.

The second load sensing part 36B includes a current transformer CT1 for sensing the amount of current flowing through induction coil IH, and peripheral components thereof. The second load sensing part 36B rectifies the current flowing through the current transformer CT1, converts it to the corresponding voltage, and then transmits the voltage signal to the microprocessor 10. Then, the microprocessor 10 determines the kind of the cooking vessel based on the amount of the current, e.g., a non-steel metallic vessel (aluminum or bronze one, etc) when the current is extra-large; a steel vessel when the current is large; a combination vessel ( for example, a vessel whose base is made of steel, and body is made of ceramics) when the current is middle; and, a non-metallic vessel (ceramic vessel, etc) when the current is small. Furthermore, when the amount of current is between the middle and small levels, the microprocessor 10 may determine that the load is an abnormal material such as a watch, spoon, or the like.

The heating manner selecting section 34 includes a relay coil RS5, and a relay coil RS4 incorporated into the malfunction preventing section 12 explained previously. The reference characters RS1 to RS3 are respectively provided for opening or closing the aforementioned contact parts ST1 to ST3.

The malfunction preventing section 12 includes a relay coil RS4, switching transistors Q1 to Q3, and peripheral components. When the user pushes the cooking start key through the key input section 22, the microprocessor 10 outputs a high level signal to the base terminal of the transistor Q1 to allow the transistor Q1 to be turned on, and outputs a high level signal to the emitter terminal of the transistor Q3 only when other conditions are all satisfied. If the transistor Q2 is turned on according to the aforementioned operation, the transistors Q1 and Q3 are turned on in order, thereby activating the relay coil RS4.

Consequently, because the relay coil RS4 is activated only when the transistors Q1 to Q3 are all turned on, the malfunction of the induction heating part 38A, due to static electricity or the like, may be effectively prevented.

The key input section 22 includes a plurality of diodes and a plurality of switches being connected to the respective diode, and are used for selecting a desired function by the user.

The alarm issuing section 16 includes a buzzer BZ and a current limiting resistor.

The coil temperature sensing section 32 includes a thermistor Th1 and peripheral components.

The cooking state sensing section 20 includes a humidity sensor HU, a thermistor Th1, an amplifier IC10, and peripheral components.

The zero crossing section 44 includes a transistor Q5, a comparator IC6, and peripheral components. In the zero crossing section 44, the voltage, which is obtained by full-wave rectifying the commercial A.C. power supply and then properly dividing the rectified voltage, is applied to the inverted (–) terminal of the comparator IC6, and the electric potential at the collector terminal of the power transistor IGBT is applied to the non-inverted (+) terminal thereof. When the electric potential VCE between the collector and emitter terminals of the power transistor IGBT1 is lower than the reference voltage value, the output terminal of the comparator IC6 is high, and therefore the transistor Q5 turns on. Next, the output terminal of the comparator IC5 is at a low level, whereas the output terminal of the comparator IC3 is at a high level by the discharge action of the condenser C2. The reference voltage may be the saturation voltage VSAT of the power transistor IGBT1.

The stable output guiding section 42 includes a current transformer CT2 for sensing current flowing through the anode of the magnetron MGT, comparators IC1 and IC2, a transistor Q4, and resistors R1 and R2 or the like. The stable output guiding section 42 is provided for preventing the magnetron MGT from being saturated due to over-energy during dielectric heating. To be more exact, because the anode current of the magnetron MGT is small at the initial run of the magnetron MGT, the output terminal of the comparator IC2 is at a low level. Accordingly, the resistor R1 is connected in parallel to the output power varying section 26 explained hereinafter, so that the reference voltage decreases and the power level supplied to the magnetron MGT also decreases.

If the state initial run of the magnetron MGT is finished by the aforementioned manner, when the anode current of the magnetron MGT, that is, the voltage across the resistor R2, is higher than the reference voltage, the output terminal of the comparator IC2 is at high level, thereby maintaining the normal power level.

On the other hand, when large current flows through the anode of the magnetron MGT, due to unexpected abnormal operation, the output terminal of the comparator IC1 remains at a low level, thereby turning on the transistor Q4. AS the transistor Q4 is turned on, the output terminal of the comparator IC3 is at a low level, so that the power transistors IGBT1 and IGBT2 are turned off.

The output condition sensing section 24 includes a current transformer CT1, a diode bridge BD2, comparators IC11 and IC12, and peripheral components. The output condition sensing section 24 senses the current flowing through the commercial A.C. power supply by the current transformer CT1, then determines the output power level based on the sensed current, and finally corrects the output power by varying the voltage applied to the non-inverted (+) terminal of the comparator IC3 of the drive signal output section 40. The output condition sensing section 24 is provided for compensating the variation in output power due to the temperature characteristics of the power transistors IGBT1 and IGBT2, and the variation in commercial A.C. power supply.

The output power varying section 26 includes photo coupler ICs, and varies the reference voltage applied to the non-inverted (+) terminal of the comparator IC3 by resistors R19 and R20 connected in parallel to the corresponding terminals of the photo coupler ICs. Accordingly, the duty cycle of the power transistors IGBT1 and IGBT2 is changed, thereby varying the total power level. The reference numeral 60 denotes a buffer circuit 10 for buffering the microprocessor 10 and peripheral circuit.

Hereinafter, the operation of the microwave oven according to the present invention will be explained in detail along with the control method thereof.

FIGS. 3(A) through (D) are flow charts illustrating a control method for a microwave oven with a function of induction heating according to the present invention.

Initially, if the user selects a desired heating manner and then pushes the cooking start key, the microprocessor 10 determines whether or not the door is closed in step S10. The step S10 is provided for determining whether or not dielectric heating (hereinafter called D/heating) or dielectric/induction switch heating (hereinafter called a combination heating) is operable. Only induction heating (hereinafter called I/heating) is operable when the door is open, whereas all of the heating manners are operable when the door is closed.

If the door is closed in step S10, the microprocessor 10 determines which heating manner is operable by sensing the material of the existing cooking vessel in steps S20 through S50, which are executed while tentatively operating the induction heating part 38A for a predetermined time interval. As the induction heating part 38A is operated, the current value flowing through the current transformer CT1 of the load sensing section 36 is varied. As a result, the microprocessor 10 determines the material of the existing cooking vessel based on the amount of the current described above.

In step S20, the microprocessor 10 determines whether or not the existing cooking vessel is made of a non-steel metal. If the existing cooking vessel is made of a non-steel metal, for example, aluminum, bronze or the like in step S20, the microprocessor 10 determines that neither I/heating nor D/heating is operable, and then the program proceeds to step S160. In step S160, the microprocessor 10 controls the section 16 to issue an alarm that the existing cooking vessel is not suitable for either of the heating manners.

If the existing cooking vessel is not made of a non-steel metal in step S20, the program proceeds to step S30 in which the microprocessor 10 determines whether or not the existing cooking vessel is exclusive for the D/heating, for example, a ceramic vessel.

If the existing cooking vessel is not made of ceramics in step S30, the program proceeds to step S40 in which the microprocessor 10 determines whether or not the existing cooking vessel is exclusive for the I/heating, for example, a steel vessel.

If the existing cooking vessel is not made of steel in step S40, the program proceeds to step S50 in which the microprocessor 10 determines whether or not the existing cooking vessel is an operable vessel (hereinafter called a combination vessel) for either D/heating or I/heating.

If the existing cooking vessel is not operable for either of the heating manners in step S50, the program proceeds to step S160 in which the microprocessor 10 controls the section 16 to issue an alarm.

If the existing cooking vessel is made of ceramics, the program proceeds to step S70 in which the microprocessor 10 determines whether or not the user selects combination heating.

If the user selects the combination heating in step S70, the program proceeds to step S160 in which the microprocessor 10 controls the section 16 to issue an alarm that the existing cooking vessel is not suitable for combination heating.

If the user does not select combination heating, the program proceeds to step S80 in which the D/heating gets started.

If the existing cooking vessel is made of steel in step S40, the program proceeds to step S90 in which the microprocessor 10 determines whether or not the combination heating is selected, again. If combination heating is selected in step S90, the program proceeds to step S160 in which the microprocessor 10 controls the section 16 to issue an alarm that the existing cooking vessel is not suitable for combination heating.

If combination heating is not selected in step S90, the program proceeds to step S100 in which the microprocessor 10 determines whether or not a thawing function is selected. If the thawing function is selected in step S100, the program proceeds to step S160 in which the microprocessor 10 controls the section 16 to issue an alarm that the D/heating is not suitable for performing the thawing function. The reason is that the foods will probably be singed while the thawing function is performed using I/heating. If the thawing function is not selected in step S100, the program proceeds to step S110 in which the I/heating gets started.

If the existing cooking vessel is a combination vessel in step S50, the program proceeds to step S120 in which the microprocessor 10 determines whether or not the combination heating is selected. If the combination heating is selected in step S120, the program proceeds to step S130 in which the microprocessor 10 determines whether or not the current heating stage is in the D/heating. If the current heating stage is in D/heating in step S130, the program proceeds to step S80 in which the D/heating is performed, whereas if the current stage is in the turn of the I/heating in step S130, the program proceeds to step S110 in which the I/heating is performed.

If combination heating is not selected in step S120, the program proceeds to step S140 in which the microprocessor 10 determines whether or not the door is closed, again. If the door is open in step S140, the program proceeds to step S110 in which I/heating is performed, whereas if the door is closed in step S140, the program proceeds to step S150 in which the heating manner selected by the user is performed.

If the door is open in step S10, the program proceeds to step S60 in which the microprocessor 10 determines whether or not the user selects a combination heating. If the user selects combination heating in step S60, the program proceeds to step S160 in which the microprocessor 10 controls the section 16 to issue an alarm that the existing cooking vessel is not suitable for the combination heating. If the user does not select the combination heating, the program proceeds to step S40 in which the microprocessor 10 determines whether or not the existing cooking vessel is exclusive for I/heating, for example, a steel vessel.

The operations of the steps S40 through S160 are the basic processes of the present invention.

Hereinafter, additional processes which may promote convenience of use, the safety and stabilization of the operation will be explained.

In step S170, the microprocessor 10 determines whether or not a material (called a small load) unsuitable for cooking, for example, watch, spoon, or the like, is mistakenly loaded in the heating chamber. This step S170 is executed based on the amount of the current flowing through the induction heating part 38A, as described above.

If the load in the heating chamber is a small load in step S170, the program proceeds to step S160, in which the microprocessor 10 controls the section 16 to issue an alarm that the load is not suitable for cooking.

If the load in the heating chamber is not a small load in step S170, the program proceeds to step S190, in which the stable output guiding section 42 is operated. The step S190 is required for preventing the unstable operation at the initial run of the magnetron MGT, and for preventing over-current from flowing through the anode of the magnetron MGT.

In step S200, the microprocessor 10 determines whether or not the microwave oven is stably operated, based on the signals from the primary and secondary sensing sections 28 and 30. If the microwave oven is unstably operated in step S200, the program proceeds to step S160, in which the microprocessor 10 controls the section 16 to issue an alarm. If the microwave oven is stably operated in step S200, the program proceeds to step S210, in which the microprocessor 10, determines whether or not a warm function is selected from the user. Here, the warm function, or automatic mode, is provided for enabling the heating of foods to a temperature set by the user.

If the warm function is selected in step S210, the program proceeds to step S220, in which the microprocessor 10 compares the temperature of the induction heating plate with the temperature set by user.

If the temperature of the induction heating plate is higher than the set temperature in step S220, the program proceeds to step S240, in which the power supplied to the induction coil IH is cut off, whereas if the temperature of the induction heating plate is lower than the set temperature in step S220, the program proceeds to step S230, in which the power is continuously supplied to the induction heating coil.

If the warm function is not selected in step S210, the program proceeds to step S250, in which the microprocessor 10 determines whether or not the temperature of the induction coil IH is higher than a reference temperature, for example 160° C., representative of overheating.

If the temperature of the induction coil IH is higher than 160° C. in step S250, the program proceeds to step S260, in which the microprocessor 10 determines whether or not the user takes some kind of preventative measures within a predetermined time interval, for example, 30 seconds. For example, it is determined whether or not the user replenishes the cooking vessel with water. This step S260 is provided for cutting off the power supplied to the induction coil IH when the water in the cooking vessel is all evaporated or the induction coil is overheated due to unexpected malfunction.

If the temperature of the induction coil IH is still higher than the reference temperature, even after 30 seconds has passed, the microprocessor 10 determines that the user does not take any measures. Accordingly the program proceeds to step S160, in which the microprocessor 10 controls the section 16 to issue an alarm that the microwave oven is in an overheating state.

If the temperature of the induction coil IH becomes lower than the reference temperature within 30 seconds, the program proceeds to step S270, in which the microprocessor 10 controls the whole operations of the microwave oven so that foods are automatically cooked according to the signal from the cooking state sensing section 20.

In step S280, the microprocessor 10 determines whether or not the cooking is finished. If the cooking is finished in step S280, the program proceeds to step S290, in which the microprocessor 10 controls the section 16 to issue an alarm that the cooking is finished. If the cooking is not finished in step S280, step S10 and following steps are repeatedly executed. The steps S210 through S260 are executed during D/heating.

While in the foregoing specification a detailed description of an embodiment of the invention has been set down for the purpose of illustration, many variations in the details herein given may be made by those Skilled in the art without departing from the spirit and scope of the invention.

I claim:

1. A microwave oven in which either induction heating or dielectric heating may be performed in a heating chamber, said microwave oven comprising:

an induction heating section including an induction coil;

a dielectric heating section including a magnetron;

a power supply section for generating high frequency power by switching D.C. power obtained by rectifying commercial A.C. power, said power supply section including a power transistor for switching the D.C. power;

a switching control section operationally connected to said power supply section for controlling the switching operation of said power supply section;

an automatic door sensing section for determining whether or not a door is open;

an automatic vessel material detecting means for sensing a material of a cooking vessel placed in the heating chamber; and, a microprocessor operationally connected to said automatic door sensing section, said automatic vessel material detecting means, said power supply section, and said switching control section for controlling said high frequency power to be selectively connected to either of said heating sections based on the state of the door and the material of the cooking vessel, wherein said automatic vessel material detecting means senses the material of the cooking vessel based on the amount of current flowing through said automatic vessel material detecting means as said induction heating section is in operation.

2. The microwave oven according to claim 1, further comprising means, connected to said power supply section, for lowering electric power supplied to said dielectric heating section until an anode current of said magnetron reaches a first reference value when the anode current is smaller than said first reference value, and for cutting off the electric power supplied to said dielectric heating section when the anode current is larger than a second reference value, wherein said first reference value is representative of the anode current after initial oscillation of said magnetron, and said second reference value is representative of over current at said magnetron.

3. The microwave oven according to claim 1, further comprising means, operationally connected to said microprocessor, for driving said induction heating section only when a set of signals with predetermined potential levels are produced from two optional output terminals of said microprocessor.

4. The microwave oven according to claim 1, further comprising means, operationally connected to said induction heating section and said power supply section, for cutting off electric power supplied to said induction heating section only when the voltage at a collector terminal of said power transistor is higher than a predetermined reference value.

5. The microwave oven according to claim 1, further comprising means, connected to said power supply section for turning on said power transistor when the voltage across collector and emitter terminals of said power transistor is lower than a predetermined reference value.

6. A method of controlling a microwave oven in which either induction heating or dielectric heating may be performed in a heating chamber, said control method comprising the steps of:

determining whether or not a door of the heating chamber is open;

determining material of a cooking vessel placed in the heating chamber; and, selectively operating a proper heating mode of a plurality of heating modes based on the state of the door and the material of the cooking vessel, and issuing an alarm when the cooking vessel is not appropriate to a selected heating modes, wherein said step of determining the material of the cooking vessel comprises the step of determining the material based on an amount of current flowing through an induction heating section while temporarily executing induction heating.

7. The method of controlling a microwave oven according to claim 6, wherein said plurality of heating modes comprises a induction heating mode, a dielectric heating mode, and a combination heating mode including the induction and dielectric heating modes.

8. The method of controlling a microwave oven according to claim 7, wherein if it is determined that the door is open in said step of determining, an alarm is issued if the selected heating mode is one of the dielectric or combination heating modes.

9. The method of controlling a microwave oven in any one of claims 7 and 8, further comprising a step of inputting a heating mode by the user before said step of determining whether or the door is open.

10. The method of controlling a microwave oven according to claim 9, further comprising the steps of:

determining whether or not a defrost function is selected by the user; and, executing said defrost function only by the dielectric heating mode when said dielectric heating mode is selected.

11. The method of controlling a microwave oven according to claim 9, further comprising the steps of:

receiving a temperature of an induction coil;

determining whether or not the temperature of the induction coil is higher than a reference temperature;

further determining whether or not the temperature of the induction coil is higher than said reference temperature after a predetermined time interval; and, forcibly ending the induction heating mode when the temperature of the induction coil is higher than said reference temperature in said step of further determining and continuously executing the induction heating mode when the temperature of the induction coil is lower than said reference temperature.

12. The method of controlling a microwave oven according to claim 9, further comprising the steps of:

determining if said automatic heating mode has been selected;

if said automatic heating mode has been selected, detecting a temperature of an induction heating plate;

determining whether or not the temperature of the induction heating plate is higher than a set temperature;

cutting off power to said induction coil if the temperature of the induction heating plate is higher than said set temperature; and continuously supplying power to said induction coil if the temperature of the induction heating plate is lower than said set temperature.

13. The method of controlling a microwave oven according to claim 6, wherein the material of the cooking vessel in said step of determining is one of an induction heating vessel, a dielectric heating vessel, an induction/dielectric combination heating vessel, and a heating impossible vessel.

14. The method of controlling a microwave oven in any one of claims 6 and 13, further comprising a step of inputting a heating mode by the user before said step of determining whether or the door is open.

15. The method of controlling a microwave oven according to claim 14, wherein said plurality of heating modes comprises an induction heating mode, a dielectric heating mode, a combination heating mode including the induction and dielectric heating modes, and an automatic heating mode.

16. The method of controlling a microwave oven according to claim 15, further comprising the steps of:

determining whether or not a defrost function is selected by the user; and, executing said defrost function only by the dielectric heating mode when said dielectric heating mode is selected.

17. The method of controlling a microwave oven according to claim 15, further comprising the steps of:

receiving a temperature of an induction coil;

determining whether or not the temperature of the induction coil is higher than a reference temperature;

further determining whether or not the temperature of the induction coil is higher than said reference temperature after a predetermined time interval; and, forcibly ending the induction heating mode when the temperature of the induction coil is higher than said reference temperature in said step of further determining and continuously executing the induction heating mode when the temperature of the induction coil is lower than said reference temperature.

18. The method of controlling a microwave oven according to claim 15, further comprising the steps of:

determining if said automatic heating mode has been selected;

if said automatic heating mode has been selected, detecting a temperature of an induction heating plate; determining whether or not the temperature of the induction heating plate is higher than a set temperature;

cutting off power to said induction coil if the temperature of the induction heating plate is higher than said set temperature; and continuously supplying power to said induction coil if the temperature of the induction heating plate is lower than said set temperature.

19. A microwave oven in which either induction heating or dielectric heating may be performed in a heating chamber, said microwave oven comprising:

an induction heating section including an induction coil;

a dielectric heating section including a magnetron;

a switching control section operationally connected to said power supply section for controlling the switching operation of said power supply section;

an automatic door sensing section for determining whether or not a door is open;

an automatic vessel material detecting section for sensing a material of a cooking vessel placed in the heating chamber; and, a microprocessor operationally connected to said automatic door sensing section, said automatic vessel material detecting section, said power supply section, and said switching control section for controlling said high frequency power to be selectively connected to either of said heating sections based on the state of the door and the material of the cooking vessel;

means, connected to said power supply section, for lowering electric power supplied to said dielectric heating section until an anode current of said magnetron reaches a first reference value when the anode current is smaller than said first reference value, and for cutting off the electric power supplied to said dielectric heating section when the anode current is larger than a second reference value, wherein said first reference value is representative of the anode current after initial oscillation of said magnetron, and said second reference value is representative of over current at said magnetron;

means, operationally connected to said microprocessor, for driving said induction heating section only when a set of signals with predetermined potential levels are produced from two optional output terminals of said microprocessor;

means, operationally connected to said induction heating section and said power supply section, for cutting off electric power supplied to said induction heating section only when the voltage at a collector terminal of said power transistor is higher than a predetermined reference value; and means, connected to said power supply section for turning on said power transistor when the voltage across collector and emitter terminals of said power transistor is lower than a predetermined reference value.

20. A microwave oven in which either induction heating or dielectric heating may be performed in a heating chamber, said microwave oven comprising:

an induction heating section for induction heating;

a dielectric heating section for microwave heating;

a power supply section for generating high frequency power;

an automatic vessel material detecting means for sensing a material of a cooking vessel placed in the heating chamber;

a microprocessor operationally connected to said automatic vessel material detecting means, and said power supply section, for controlling said high frequency power to be selectively connected to either of said heating sections at least based on the material of the cooking vessel; and an automatic door sensing section for determining whether or not a door is open, wherein said microprocessor is operationally connected to said automatic door sensing section for controlling said high frequency power to be selectively connected to either of said heating sections also based on whether or not the door is open; and wherein said automatic vessel material detecting means senses the material of the cooking vessel based on the amount of current flowing through said automatic vessel material detecting means as said induction heating section is in operation.

21. The microwave oven according to claim 20, wherein said automatic vessel material detecting means senses the material of cooking vessel based on the amount of current flowing through said automatic vessel material detecting means as said induction heating section is in operation.

22. The microwave oven according to claim 20, wherein said dielectric heating section comprises a magnatron, and said oven further comprising means, connected to said power supply section, for lowering electric power supplied to said dielectric heating section until an anode current of said magnetron reaches a first reference value when the anode current is smaller than said first reference value, and for cutting off the electric power supplied to said dielectric heating section when the anode current is larger than a second reference value, wherein said first reference value is representative of the anode current after initial oscillation of said magnetron, and said second reference value is representative of over current at said magnetron.

23. The microwave oven according to claim 20, further comprising means, operationally connected to said microprocessor, for driving said induction heating section only when a set of signals with predetermined potential levels are produced from two optional output terminals of said microprocessor.

24. The microwave oven according to claim 20, wherein said power supply section includes a power transistor for switching the D.C. power and wherein said oven further comprises means, operationally connected to said induction heating section and said power supply section, for cutting off electric power supplied to said induction heating section only when the voltage at a collector terminal of said power transistor is higher than a predetermined reference value.

25. The microwave oven according to claim 24, further comprising means, connected to said power supply section for turning on said power transistor when the voltage across collector and emitter terminals of said power transistor is lower than a predetermined reference value.

26. The microwave oven according to claim 20, further comprising a switching control section operationally connected to said power supply section for controlling the switching operation of said power supply section.

* * * * *